US006272688B1

(12) United States Patent
Wilson

(10) Patent No.: US 6,272,688 B1
(45) Date of Patent: Aug. 14, 2001

(54) HIGH VISIBILITY DETACHED SAFETY SLEEVE AND METHOD OF MANUFACTURE

(76) Inventor: Toney Hugh Wilson, 295 Sinclair Dr., Sarasota, FL (US) 34240

( * ) Notice: Subject to any disclaimer, the term of this patent is extended or adjusted under 35 U.S.C. 154(b) by 0 days.

(21) Appl. No.: 09/756,444

(22) Filed: Jan. 8, 2001

(51) Int. Cl.[7] ..... A41D 1/00
(52) U.S. Cl. ..... 2/170; 2/16; 2/59; 2/DIG. 1
(58) Field of Search ..... 2/22, 23, 16, 59, 2/269, DIG. 1, 170

(56) References Cited

U.S. PATENT DOCUMENTS

| | | | |
|---|---|---|---|
| 2,534,313 | * | 12/1950 | Starkey . |
| 2,656,763 | * | 10/1953 | Frost . |
| 3,657,741 | * | 4/1972 | Blanco . |
| 3,837,007 | | 9/1974 | Girest . |
| 4,856,112 | * | 8/1989 | Effle . |
| 5,143,762 | * | 9/1992 | Ho . |
| 5,940,881 | * | 8/1999 | Murphy . |
| 6,092,235 | * | 7/2000 | Santa Cruz et al. . |
| 6,205,593 | * | 3/2001 | Schaub . |

FOREIGN PATENT DOCUMENTS

2245477 * 1/1992 (GB) .

* cited by examiner

*Primary Examiner*—Rodney Lindsey
(74) *Attorney, Agent, or Firm*—Dorothy S. Morse

(57) ABSTRACT

A fluorescent orange, elongated, tubular, thin-walled device, and method of manufacture, that is substantially rectangular in appearance when laying flat and fully extended, having an open end and an opposing end closed with a small hole adapted for insertion of a hand or foot, which when deployed over a human limb substantially covers it. The selected thickness of the plastic material used allows the device to be flexible, stretch without tearing, and have sufficient rigidity for use without straps or ties. Surface markings can provide cutting lines to shorten the device for children, advertising indicia, and/or aesthetic design. A pocket and small perforations to enhance user comfort in warm weather are also optional. Applications can include, but are not limited to, use by stranded motorists, law enforcement officers, airport personnel, school crossing guards, cyclists, hikers, downhill and cross-country skiers, hunters, people stranded at sea, and private pilots in downed airplanes.

20 Claims, 1 Drawing Sheet

HIGH VISIBILITY DETACHED SAFETY SLEEVE AND METHOD OF MANUFACTURE

BACKGROUND—FIELD OF INVENTION

This invention relates to warning devices and devices used for attracting attention when a person needs assistance, or otherwise needs to be highly visible, specifically to a fluorescent orange, elongated, tubular, thin-walled, flexible device, and a method for its manufacture, that is substantially rectangular in appearance when not in use and laying flat in a fully extended position, having one open end and an opposing end that is closed with the exception of a small centrally located, stretchable starter hole for use in inserting and withdrawing a hand through the substantially closed end. The length of the present invention would preferably extend from a person's wrist to his or her shoulder, although it could also be used over a leg. The wall thickness of the plastic material would be selected so that the device is flexible, has some capability of stretching without tearing so that it can be reused, and has sufficient rigidity so that the device will remain in its usable position without straps, ties, or other means of attachment to the person using it, or to that person's clothing. Optionally, markings could be added to the surface of the device to provide cutting lines to shorten the device for children, advertising indicia, and/or aesthetic design. A pocket is also optional, for use in inserting instructions for use, advertising information, a business card, or multipurpose use by the person wearing it. Further, small spaced-apart perforations may be formed in the device, pre or post manufacture, to enhance user comfort during warm weather. Applications can include uses where enhanced visibility is desired and/or to signal the need for emergency assistance, such as but not limited to, use over the limbs of stranded motorists needing to change a tire or while walking along a roadway to obtain gas or assistance; by law enforcement officers while directing traffic or during an investigation of an accident scene; by ground control personnel directing airplane traffic during reduced visibility conditions; by motorcycle riders, other cyclists, and those riding other wheeled vehicles for enhanced visibility at night and during the day; by hikers lost or injured in the wilderness to signal a need for assistance; by school crossing guards; by injured downhill or cross-country skiers in remote areas; by hunters needing assistance; by people stranded at sea; and by private pilots in downed planes needing to be spotted from the air. Also, in the alternative, two or more of the highly visible, flexible fluorescent orange devices can be tied together and attached to a tree, or to an abandoned vehicle, airplane, or boat, to indicate the need for emergency assistance; the devices could be attached to a person's belt, belt loop, or other article of clothing or garment accessory to attract attention and signal the need for emergency assistance when coverage of a human limb is not appropriate due to injuries sustained; as well as portions of the thin-walled flexible material can be easily cut from the remainder of the device, or torn therefrom by a person of average strength, and secured on a succession of small tree limbs to mark a trail for rescuers to a cave or other location hidden from direct view that is temporarily used for shelter from wildlife and/or inclement weather, with the remainder of the device being worn by the person to enhance his or her visibility and increase the likelihood of a prompt rescue.

BACKGROUND—DESCRIPTION OF PRIOR ART

Safety devices are known that enhance the visibility of cyclists, walkers, motorcycle riders, and the like. Typically, reflective patches or strips are added to a vest, shoes, hat, or pants to accomplish this purpose. Also, lighted devices are known that can be strapped around an arm, head, chest, or leg, or incorporated into clothing, which operate to provide steady or intermittent light transmission. However, reflective material is not suited for enhanced visibility from a great distance or during daylight hours, and batteries powering a lighted device typically fail in a short period of time. Further, neither is effective as a marker that can be seen from the air to identify the location of a stranded hunter, hiker, skier, or pilot needing to seek shelter from the wind during inclement weather. Also, particularly if not configured as an article of clothing, safety devices for enhanced visibility and emergency use that are carried in a pocket, vehicle glove compartment, backpack, equipment bag, or a camera bag attached to a belt or worn around the waist, need to be as light in weight as possible, and compact in configuration, for easy transport. Batteries are heavy, as well as bulky, and most hunters, hikers, climbers, and skiers using a backpack or other equipment bag would be unwilling to carry a supply of batteries adequate for extended emergency use. Further, it would be desired for any disposable devise employed for high visibility use to be inexpensively and easily made, simply constructed and designed for fast deployment and removal, made for reuse more than once if so desired, and made from materials that can be recycled to promote environmental considerations.

The use of fluorescent orange coloring is also known for providing high visibility. By law hunters are required to personally display a specified minimum surface area of bright orange coloring for safety. When the present invention is worn on both arms, it would adequately satisfy the hunting requirement, and also provide additional safety advantages, such as small portions of the thin-walled flexible material being able to be easily cut from therefrom and readily attached to small tree branches, or to vertically extending rigid stalks of grass or other plant vegetation, and used as a trail marker by a person injured or lost in the woods, with the remainder of the device being worn by the person to enhance his or her visibility and increase the likelihood of a prompt rescue. Also, the present invention would be lightweight and easily folded into a compact configuration for storage, a concern of cyclists, walkers, climbers, and skiers alike when there is a need to carry emergency supplies. Further, there is no accessory, permanently connected thereto or detached, needed for attaching the present invention over the limb of a person needing high visibility. The thin-walled material of the present invention, and the preferably half-moon shaped starter hole that is smaller than the smallest adult hand contemplated for use therewith, allows a comfortable but stretchable wrist connection, and the approximate one millimeter minimum thickness of the material used allows the present invention to have a sufficient amount of rigidity to resist the force of gravity that might otherwise cause it to become longitudinally collapsed and shortened during use, wherein it would no longer have an optimal attention attracting effect. Reuse of the present invention is possible since the starter hole would stretch without tearing, and then substantially regain its former configuration once a limb is withdrawn therefrom. Further, the present invention is sufficiently inexpensive to make and use, allowing for an option of disposal or recycling after a single use.

The invention thought to be the closest in concept to the present invention is disclosed in U.S. Pat. No. 3,837,007 to Girest (1974). The Girest invention comprises a pair of lightweight sleeves extending from a person's wrist to the shoulder each having reflective material attached thereto. However, the Girest invention is different from the present invention in several important ways. The Girest invention has restrictive means at its wrist end and a strap at the opposed end for attachment to the epaulette of a uniform. The present invention has an open end and an opposing substantially closed end with a centrally located, stretchable starter hole for use in inserting and withdrawing a hand therethrough. The thickness dimension of the material used to make the sleeves of the present invention is sufficiently thin so that sleeve is flexible for easy deployment over an arm, or a leg, while maintaining sufficient rigidity so that it remains fully deployed during use, without collapse and without attachment to underlying clothing. Further, the thin-walled construction of the present invention makes it capable of being folded into a compact configuration of less than two cubic inches for easy addition to an emergency/safety kit, or for transport in a backpack or equipment bag by hikers, skiers in remote areas, hunters, cyclists, and the like. Also, the material of the present invention comprises a highly visible plastic that is fluorescent orange in color, and not a material having reflective properties. Further, the material used in the present invention is capable of stretching so that as a hand is inserted through the starter hole the material does not become ripped or torn and thereafter is able to recover its original configuration to closely fit around the wrist during use. No device or method is known for visibility enhancement that has all of the advantages offered by the present invention.

SUMMARY OF INVENTION—OBJECTS AND ADVANTAGES

The primary object of this invention is to provide a multi-purpose, flexible, inexpensive, easily deployed and removed device for use by people needing enhanced visibility. It is also an object of this invention to provide a device for enhancing visibility that is light in weight and capable of being stored in a compact configuration. It is a further object of this invention to provide a device for enhanced visibility that can be easily and cost-effectively adapted for use during warm weather. It is also an object of this invention to provide a device for enhanced visibility that is comfortable to wear and stays in place once deployed without the assistance of accessory devices, or attachment to underlying or adjacent clothing. It is a further object of this invention to provide a device for enhanced visibility that can easily assist a person lost in the wilderness in marking a trail for rescuers to follow. It is also an object of this invention to provide a device for enhanced visibility that is usable by all people, irrespective of stature. It is a further object of this invention to provide a device for enhanced visibility that can be easily joined to other like devices to increase signaling effectiveness during emergency use.

The present invention has many uses, to include but not be limited to, use over the arms or legs of a stranded motorist changing a tire, use by a person walking along a roadway under reduced visibility conditions, use by law enforcement officers while directing traffic during daylight or night hours, use by law enforcement officers while investigating an accident scene, use by flight line personnel at airports, use by those riding motorcycles, mopeds, scooters, and bicycles, use by hunters to satisfy safety requirements, use by school crossing guards, and use as part of an emergency kit for those periodically subject to unexpected snow storms or those on extended boating or fishing trips. The present invention is also inexpensive to manufacture and use, since it is made from thin-walled plastic material, and its configuration is a simple tubular design that does not require the use of accessory devices to secure it into its deployed position. The present invention is also easily deployed and removed. To place the present invention over a limb, one would first grasp the tubular body near to its open end with both hands to separate the opposing interior surfaces from one another. The fingers and thumb on one hand, or the toes of one foot, would then be inserted into the open end of the tubular body until they reached the starter hole centrally located in the opposing closed end of the tubular body. The starter hole would preferably be half-moon shaped and slightly smaller than the smallest hand or foot contemplated for use therewith. The fingers or toes would then be forced against the starter hole, while the sleeve is held in a stationary position and until the thin-walled plastic material becomes stretched around the fingers or toes to allow them to pass through the starter hole without any ripping or tearing of the plastic material. Once through the starter hole, the fingers or toes would continue to move beyond the starter hole until the starter hole became positioned around the user's wrist or ankle. The elasticity in the thin-walled plastic material used for the tubular body would then allow it to regain much of its original configuration to provide a comfortable but secure fit around the user—s wrist or ankle. One or both of the user—s hands would then be used to extend the tubular body longitudinally along a substantial portion of the arm or leg to which it is secured at the wrist or ankle. The tubular body will be flexible in its usable position, however it has sufficient thickness to be able to maintain the configuration into which it is placed during use without collapsing or otherwise being affected by gravity. The thin-walled plastic makes the present invention light in weight and capable of being folded in a compact configuration having a maximum volume of approximately two cubic inches. Its maximum weight would be little more than one ounce, making it easy to transport. The low weight also provides an energy conserving advantage to the person wearing it, since the tubular body will not add significant weight to the arms or legs of a user and cause an undue drain on the person's stamina. Use of perforated or partially perforated material for the tubular body would make the present invention comfortable for use during warm weather. Although not easily ripped or torn, the thin-walled tubular body material can be easily cut with a sharp object, such as a small utility knife, or punctured with a sharp fingernail, and used to mark a trail for those looking for a person lost in the wilderness. For example, small pieces of the highly visible fluorescent orange material could be periodically attached to the ends of a succession of small low-hanging tree limbs and positioned thereon so that each piece can be easily spotted by a person attempting to track another for rescue. Since the material is stretchable, it would not be easily dislodged by the wind from its position, once it is forced over the end of a small tree limb or onto the vertically extending stalk of a rigid piece of grass or other plant vegetation. Until substantially used in a trail marking capacity, the remaining portion of the tubular body would continue to be deployed on the person's arm or leg and provide a broad band of highly visible fluorescent orange material that is easily spotted from a distance by a rescuer. Since the width dimension of the preferred embodiment when fully extended and laying flat in a rectangular configuration would be approximately nine inches, and its preferred length dimension would be approximately eighteen to twenty inches, it is anticipated that this one size would adequately extend between the wrist and shoulders of most people and cover a substantial amount of the arm, to effectively fulfill its emergency signaling function. Excess material extending laterally beyond an arm would lay in a substantially flat configuration, not drooping or sagging, thereby enhancing the arm's visibility. Although the present invention could be shortened by temporarily folding back a portion of the plastic adjacent to the open end over an adjacent portion of the remaining plastic for use by those with exceptionally short arms, it is contemplated that markings could be provided on the outside surface of the tubular body for use as cutting lines in permanently shortening the tubular body for use by those with short arms, including children. Instead of placement over a person's limb, such as where a person's injuries would prevent deployment over an arm or a leg, as a substitute method of use the thin-walled tubular bodies can be easily tied to an accessory used by the person, such as but not limited to a belt, belt loop, backpack, over-the-shoulder bag, or water bottle carrier. Also, two or more of the highly visible fluorescent orange devices can be tied together and attached to a tree, or an abandoned motor vehicle used for ground transportation, airplane, or boat, to signal the need for emergency assistance, particularly when the people stranded need to leave a vehicle or accident sight to seek shelter during extreme weather conditions, or for other safety related considerations. Also, when airborne rescue is anticipated, several of the highly visible fluorescent orange devices can be secured together, or in positions close to one another on the ground, and placed in an eye-catching horizontally extended configuration that allows for a maximum amount of exposed surface area, and a greater likelihood that the fluorescent orange color of the devices can be spotted from the air.

The description herein provides the preferred embodiments of the present invention but should not be construed as limiting the scope of the high visibility safety sleeve invention. For example, the exact width and length dimensions of the tubular body, the thickness of the material used for the tubular body, the size and shape of the centrally located starter hole in the closed end of the tubular body, and the amount of elasticity in the material used for the tubular body, other than those shown and described herein, may be incorporated into the present invention. Thus, the scope of the present invention should be determined by the appended claims and their legal equivalents, rather than the examples given.

DETAILED DESCRIPTION OF PREFERRED EMBODIMENTS

It is intended for the high visibility safety sleeve of the present invention to be used alone or as part of a safety kit to be carried by hikers, motorists, skiers, marine enthusiasts, and the like. Although not shown, the kit contemplated would preferably include a pair of high visibility safety sleeves, a thermal blanket, a flashlight, a pencil and paper, a clothespin or clip, and several waterproof matches. The high visibility safety sleeves in the kit could be used alone or in combination with each other, as well as with the safety sleeves in other kits, to mark the location of a person, a vehicle, gear, or a trail to needed shelter in inclement weather. The clothespin or clip could be used to attach one or more of the safety sleeves in a joined configuration to a tree limb, a motor vehicle door handle, a windshield wiper, the upper edge of a retractable window, or other object whereby the safety sleeve would be in an optimum, readily observed position. Although not limited thereto, the most preferred embodiment of the high visibility safety sleeve would weight little more than an ounce, be foldable into a configuration having a volume less than two cubic inches, and when fully extended and laying flat in a rectangular configuration it would exhibit a width dimension of approximately nine inches, as well as a length dimension between approximately eighteen and twenty inches.

Figure 4:
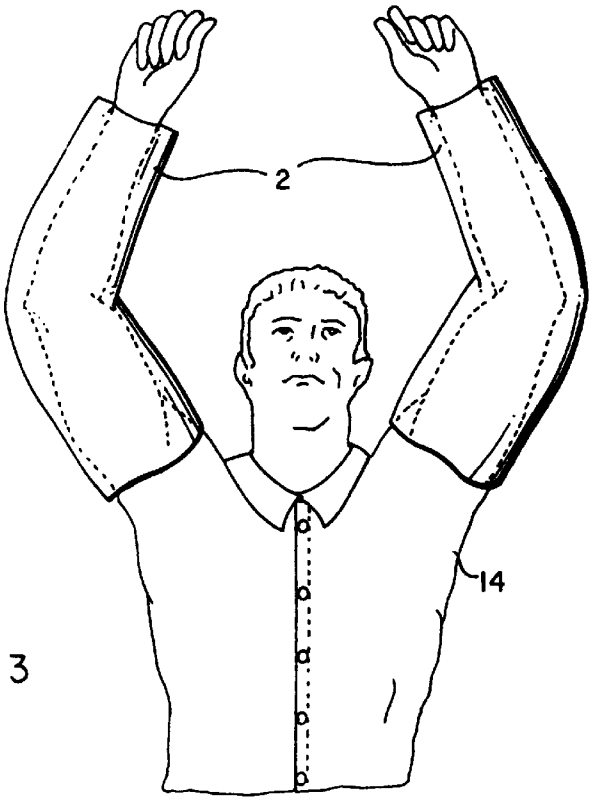
FIG. 4 is a front view of a person wearing one of the present inventions on each arm, with the arms extended overhead in a position as if to be signaling for assistance.
Figure 3:
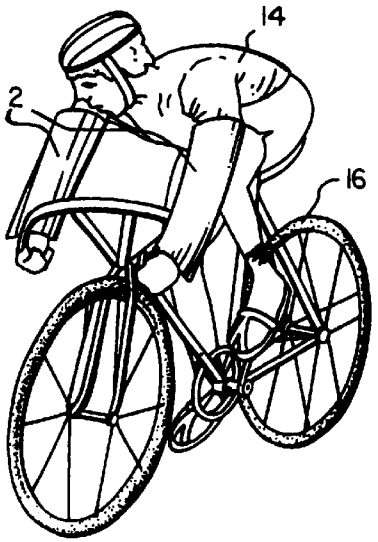
FIG. 3 is a perspective view of a cyclist wearing one of the present inventions on each arm for enhanced visibility.
Figure 1:
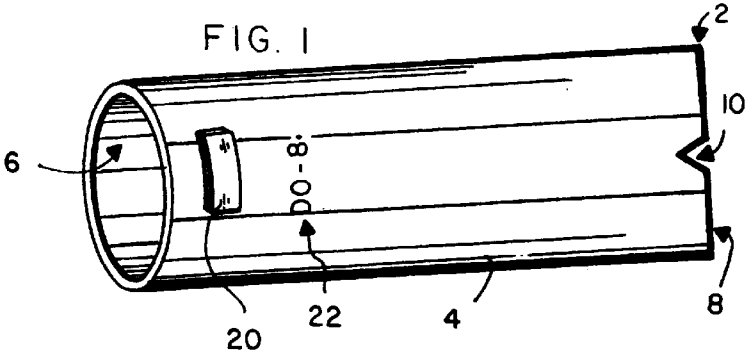
FIG. 1 is a perspective view of a first preferred embodiment of the present invention in a fully extended configuration, and having a starter hole with an angular perimeter configuration, as well as a pocket and informational markings.

FIG. 1 shows a first preferred embodiment of the present invention 2 having a tubular body 4 of thin-walled material in an extended configuration, ready for use, with an open end 6 capable of being formed into a substantially circular, tubular configuration and an opposed closed end 8 having a substantially flattened, rectangular configuration. Initially and between uses when saved for reuse, it is contemplated for tubular body 4 to be folded repeatedly until it exhibits a compact configuration requiring a minimal amount of storage volume, that is preferably limited to a maximum volume of approximately two cubic inches. FIG. 1 also shows closed end 8 having an angularly formed, centrally located starter hole 10, in the form of a cutout portion or notch with a linear perimeter configuration, through which fingers or toes would be inserted, such as the fingers on hand 12 in FIG. 2, during deployment of tubular body 4 over an arm or a leg to provide enhanced visibility for the limb once it becomes positioned within tubular body 4. It is contemplated for starter hole 10 to be slightly smaller than the smallest adult hand 12 with which use is anticipated. Further, the configuration of starter hole 10 is not critical, and it is also considered within the scope of the present invention for starter hole 10 to have an arcuate perimeter, such as that of a half-moon shown in FIG. 2, or alternatively to have a combined curvilinear perimeter (not shown). However, whether starter hole 10 has an initial angular, arcuate, or curvilinear configuration, during use starter hole 10 will always be temporarily stretched into an anchoring position whereafter its configuration will adapt to the curvature of the wrist or ankle to which it becomes attached. When the entire tubular body 4 of the first preferred embodiment is in a flattened condition, with opposing inside surfaces positioned adjacent to one another, tubular body 4 would have a substantially rectangular configuration. Although not shown, if the preferred embodiment of present invention 2 is made from a large, substantially rectangular piece of material having length and width dimensions of approximately nineteen inches square, the material used to make tubular body 4 could have a one-half inch longitudinal seam and a one-half inch transverse seam on closed end 8, and result in tubular body 4 having the nine by eighteen inch preferred width and length dimension measurements mentioned above. Since it is preferred that tubular body 4 be made from a substantially uniform thin-walled plastic material, having a maximum thickness dimension of approximately two millimeters and a minimum thickness dimension of approximately one millimeter, any seams made would preferably be heat-sealed, instead of being stitched with a separate filamentous material (not shown). This would reduce the time required for manufacture of present invention 2, and would also better preserve the structural integrity of tubular body 4 during use, as the repeated closely-spaced punctures that would be needed in tubular body 4 for the insertion of a filamentous material to form a stitched hem would weaken it, such as would be made with the use of a lightweight thread inserted through tubular body 4 with a needle (not shown). In the alternative, the material used to make tubular body 4 could have length and width dimensions of approximately nine and forty inches, be folded in half lengthwise to form a two-layer rectangular configuration having perimeter dimensions of approximately nine inches by twenty inches, with the side edges of tubular body 4 being heat sealed together to form seams having a width dimension less than approximately one-thirty-seconds of an inch and a half-moon shaped starter hole 10 having minimum length and width dimensions of two inches and one-half inch, respectively, cut into each half of the folded substantially closed end 6 of tubular body 4. It is also contemplated that the material from which present invention 2 is made would comprise a highly visible color that can be seen at great distances, such as fluorescent orange. It would need to be a color that is easily contrasted to the green and brown colors most often found in nature, as well as easily contrasted against white snow, so that an observer in an airplane flying at several thousand feet above the ground can readily view it. It is also contemplated for the material used for tubular body 4 to be substantially opaque or translucent, although when a single layer of such material is held closely against an object having sharply contrasting color or a distinctive texture or design, portions of the underlying object might be visible through tubular body 4. It is further contemplated for the material used in tubular body 4 to be flexible and exhibit some elastic properties so that starter hole 10 can stretch over a hand or foot without ripping or tearing, and then sufficiently contract to become comfortably biased against the wrist or ankle of the person wearing tubular body 4 so as to provide an anchoring point for the first preferred embodiment of present invention 2, thus also allowing removal of tubular body 4 by allowing open end 6 to be easily grasped by the fingers of the wearer's opposing hand and pulled downward from the wearer's shoulder, over the wearer's elbow, and away from the wrist anchoring point. As shown in FIGS. 3 and 4, it is contemplated for tubular body 4 to extend from the wrist of the person 14 wearing it, to a position close to the shoulder of person 14. If deployed over a leg, it is contemplated that at a minimum tubular body 4 would cover the lower leg of the person wearing it, and a large portion if not all of the upper leg. For use by shorter people, tubular body 4 would also cover the knee unless the perimeter edge of open end 6 was folded back upon the adjacent portion of tubular body 4 to avoid the knee where repeated bending of the knee was anticipated during use, such as use to change a flat or otherwise damaged automobile tire (not shown). Use by people having short arms, including children, could also be facilitated by similar folding back of the perimeter edge of open end 6. Use of present invention 2 on the arms of a policeman or other person directing traffic in an emergency situation, or by police investigating an accident scene, would also enhance the emergency worker's visibility and promote personal safety, as even when the policeman or other emergency worker wears a safety-enhancing vest, a vest is not always readily visible when the policeman or worker is viewed from the side. The present invention 2, particularly when a part of a safety kit routinely carried in the glove compartment or trunk of a car, would quickly, conveniently, and easily remedy the visibility deficiency inherent in a vest by providing a lightweight, non-collapsing safety enhancement that is highly visible from all viewing positions, the emergency worker's front, back, and left side, as well as his or her right side.

Although once unfolded for use, some of the fold lines (not shown) in tubular body 4 may remain visible. It is expected that the resiliency of the plastic material used for tubular body 4 would not permit such fold lines to interfere with the full deployment thereof, or the ability of tubular body 4 to remain in a deployed position unaffected by gravity during the full duration of use. Further, although not shown in FIG. 1 but illustrated in FIG. 2, it is contemplated for tubular body 4 to optionally have spaced-apart perforations 18 therein to minimize dehydration of a human limb covered by tubular body 4 during hot weather. Further, although not limited thereto, in the first preferred embodiment of present invention 2 when tubular body 4 has width and length dimensions of approximately nine inches and twenty inches, respectively, starter hole 10 would preferably have an initial non-stretched width dimension of approximately two or three inches and a non-stretched height dimension of approximately one-half or five-eighths of an inch. Since tubular body 4 is substantially symmetrical in configuration, it could interchangeably be used on a left or right limb without accommodation. Also, it is preferred that the plastic material from which the tubular body 4 in the first preferred embodiment of present invention 2 is made would be extruded, and not woven. As a result, the cut edges of starter hole 10 and open end 6, would not need to be turned over into a hem to prevent fraying or unraveling if present invention 2 was needed for extended or repeat use. The time saved during manufacture of present invention 2 by the omission of a hemming step would be significant and help to minimize production costs.

FIG. 1 further shows tubular body 4 having a pocket 20 on its outside surface. Although the pocket 20 in FIG. 1 has a rectangular configuration, the size and configuration of pocket 20 is not critical. However, pocket 20 should not be so large as to allow storage of a large number of objects (not shown) that would weight down and thereby prematurely drain energy reserves from an arm or leg during extended use of tubular body 4, or interfere with any activity performed by the person wearing present invention 2. Although not shown, pocket 20 could alternatively be made an appropriate size for insertion of a business card identifying the manufacturer or a distributor; an identification card providing personal information relating to the person wearing it; instructions provided by the manufacturer or distributor for deployment or use of tubular body 4; or several coins or pieces of folding currency, or a telephone calling card, that could be used to purchase food or drink, or make a telephone call to summon help. Pocket 20 could be made from transparent material, or the same fluorescent orange material used for tubular body 4. Also, it is contemplated that pocket 20 would be made from an extruded plastic material, and for all but one edge of pocket 20 to be heat-sealed to tubular body 4. If it is to be used by the person wearing tubular body 4 for the temporary storage of coins or folding money, or a telephone calling card, it is contemplated that the unsealed edge of pocket 20 would be aligned with and positioned adjacent to open end 6. FIG. 1 also shows alpha-numeric surface markings 22 on tubular body 4. While surface markings 22 could be used to provide advertising messages, it is equally contemplated for surface markings 22 to provide other forms of information, such as information about the manufacturer or distributor, an inventory control designation, or a patent number. Although not shown in FIG. 1, surface markings 22 in preferred embodiment 2 could also comprise decorative designs and/or at least one line adjacent to open end 6 for use as a cutting line to shorten tubular body 4 so as to provide a more comfortable use by people with short arms and children (not shown), such as children riding a bicycle, in-line skating, or using other types of wheeled sports equipment.

It is anticipated that the first preferred embodiment of present invention 2 would have a compactly folded configuration for efficient storage. Therefore, to use present invention 2 to provide enhanced visibility for an arm or leg, tubular body 4 would first need to be unfolded into an extended, substantially rectangular configuration that allows access to open end 6. Either one or two hands can be used for most of the deployment and removal steps involving placement of tubular body 4 over an arm or a leg. Also, it is contemplated for the deployment and removal steps described herein to be easily accomplished solely by the person needing to display tubular body 4 on one or more of their limbs for safety purposes or to summon emergency assistance, or in the alternative by a second person assisting the person requiring high visibility. The inside surfaces of open end 6 would be separated from one another and the fingers or toes attached to the arm or leg requiring high visibility would be inserted into open end 6. With open end 6 being held by one hand, the fingers, hand, elbow and upper portion of an arm needing high visibility, or in the alternative the toes, foot, lower portion and knee of a leg requiring high visibility, would successively be inserted into tubular body 4. When the tip of the fingers or toes reach closed end 8, open end 6 would be manipulated so that the fingers or toes are directed toward centrally located starter hole 10. The hand grasping open end 6 would then further pull open end 6 away from the fingers or toes until the plastic material of tubular body 4 surrounding starter hole 10 sufficiently stretches to cause the hand or foot, respectively, of the arm or leg needing high visibility to completely emerge through starter hole 10 and remain in a position extending beyond starter hole 10. Once the hand or foot moves beyond closed end 8, the elasticity of the plastic material comprising tubular body 4 would cause starter hole 10 to contract around and become comfortably biased against the wrist or ankle adjacent to the respective newly emerged hand or foot. With starter hole 10 securely anchored around a wrist or ankle, open end 6 may be further pulled away from the anchored wrist or ankle and placed into its fully deployed configuration. The thickness of the material used for tubular body 4 would allow tubular body 4 to resist the force of gravity and remain fully deployed during the entire period of use. To remove tubular body 4 from an arm, the person wearing it would grasp closed end 8 with his or her opposite hand and exert a pulling force on closed end 8 to move starter hole 10 over the hand attached to the arm needing high visibility. To remove tubular body 4 from a leg, the person wearing it would grasp closed end 8 with one or both hands and exert a pulling force on closed end 8 to move starter hole 10 over the foot attached to the leg needing high visibility. During the removal process, the portion of the material comprising tubular body 4 adjacent to starter hole 10 would again be stretched so as to allow the hand or foot to move back within tubular body 4. Continued exertion of a withdrawing force to closed end 8 will allow tubular body 4 to be promptly removed from the previously covered arm or leg, whereafter tubular body 4 may be discarded, recycled, reused, or refolded for storage and later reuse.

Figure 2:
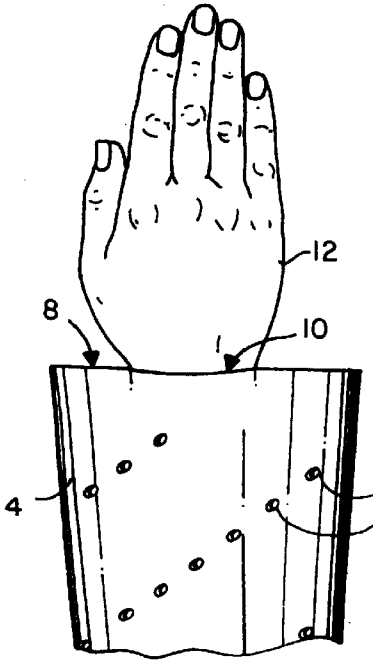
FIG. 2 is top view of a hand and fingers being inserted through the starter hole in the closed end of the tubular body of a second preferred embodiment of the present invention having a starter hole with a more rounded, half-moon shaped configuration.

FIGS. 2, 3 and 4 show the present invention in use. FIG. 2 shows starter hole 10 centrally positioned within the closed end 8 of tubular body 4. FIG. 2 also shows a hand 12 extending beyond starter hole 10, with starter hole 10 biased around the wrist adjacent to hand 12 to provide an anchoring point during deployment and removal of tubular body 4 from the adjacent arm (not shown). Instead of the angular configuration shown in FIG. 1, in FIG. 2 starter hole 10 is shown as having an arcuate perimeter, such as that of a half-moon. Although not shown, it is also considered within the scope of present invention 2 for starter hole 10 to have an initially curvilinear perimeter configuration. The maximum initial height of starter hole 10 on each side of tubular body 4 would be approximately one-half inch to five-eighths of an inch. The maximum initial width of starter hole 10 is contemplated to be approximately three inches. FIG. 2 further shows the portions of tubular body 4 extending laterally beyond the arm connected to hand 12 as being substantially flat during use, instead of having a rounded cross-sectional configuration. Since tubular body 4 has a uniform width dimension and a human arm typically increases in diameter as it approaches the shoulder, the portion of tubular body 4 adjacent to the wearer's wrist and elbow is generally much larger than that of the underlying arm, and when tubular body 4 is deployed over an arm, a large amount of tubular body 4 will laterally extend beyond the arm to give the distal portion of tubular body 4 a substantially rectangular appearance during use. In the alternative, although not shown, since human legs typically are larger in diameter than human arms, when tubular body 4 is deployed over a human leg, a smaller portion of tubular body 4 would laterally extend beyond the leg to give the distal portion of tubular body 4 a more rounded appearance during use. Also, when previous use of a tubular body 4 has only involved deployment over an arm, it is contemplated that tubular body 4 could be easily reused at a subsequent time over another an arm or a leg. However, when tubular body 4 is first deployed over a leg and depending upon the size of the foot inserted therethrough, there is a possibility that starter hole 10 could be sufficiently stretched so as not to easily recover its pre-stretched configuration. If this were to occur, reuse of tubular body 4 would then be more likely suitable only for redeployment over a leg, and not an arm, as the plastic material adjacent to starter hole 10 would no longer be able to provide the function of anchoring closed end 8 in and around a wrist. Reuse of a tubular body 4 having an overstretched starter hole 10, although not shown, could alternatively include attachment to one or more additional tubular bodies 4, a belt loop, a belt, an automobile antenna, a motor vehicle door handle, a backpack, or the like, to signal the need for emergency assistance, instead of use in providing enhanced visibility to a human limb. FIG. 2 further shows several rows of perforations 18 in tubular body 4, for use in preventing dehydration of a covered arm or leg during deployment through excessive perspiration during hot weather conditions. The size, number, configuration, placement, and spaced-apart distance between perforations 18 are not critical to the present invention as long as they enhance the comfort of the person wearing tubular body 4 during hot weather without weakening the integrity of tubular body 4 to the point where it can no longer fulfill its function and remain fully deployed over a human limb during an entire period of use. Thus, perforations 18 can be uniformly spaced apart and cover substantially all of tubular body 4, or in the alternative perforations 18 can cover one or more selected portions of tubular body 4.

FIG. 3 shows a person 14 in a seated position upon a wheeled vehicle 16, while FIG. 4 shows a person 14 with both arms raised overhead in a position as if to be summoning emergency assistance. In both FIG. 3 and FIG. 4, person 14 is wearing two preferred embodiments of present invention 2, each in a position extending from the shoulder to the adjacent wrist, on a different arm of person 14. All present inventions 2 appear to have a flattened, rectangular configuration that extends laterally beyond the arms of person 14 and provides enhanced visibility, greater visibility than if the safety sleeves of present invention 2 were made from material having a thinner wall-thickness that would be more affected by the force of gravity and thereby made to sag or droop during deployment. To minimize such sagging and drooping, it is contemplated that the plastic material forming each tubular body 4 would have a minimum thickness dimension of one millimeter. However, for weight considerations and compact folding for efficient storage and transport, it is contemplated that the preferred wall-thickness dimension of tubular body 4 would be no greater than approximately two millimeters. In addition to visibility, the plastic material used for tubular bodies 4 would be weather resistant and provide protection from rain and wind, even those embodiments having perforations 18. Although FIG. 3 shows preferred embodiments 2 being used for enhancing the visibility of a cyclist, other applications are contemplated and can include use to enhance visibility and/or signal the need for emergency assistance, such as is shown in FIG. 4, or use over the limbs of stranded motorists needing to change a flat or damaged tire or while walking along a roadway to obtain gas or assistance, use by law enforcement officers while directing traffic or investigating an accident scene, use by ground control personnel directing airplane traffic during reduced visibility conditions, use by hikers lost or injured in the wilderness, and use by school crossing guards, injured downhill or cross-country skiers in remote areas, hunters to improve visibility and satisfy safety requirements, people stranded at sea, and private pilots in downed planes needing to be spotted from the air. Also, in the alternative, two or more of the highly visible fluorescent orange tubular bodies 4 can be tied together and attached to a tree, or an abandoned vehicle, airplane, or boat, to indicate the need for emergency assistance; the tubular bodies 4 could be attached to a person's belt, belt loop, or other article of clothing or garment accessory; as well as portions of the thin-walled flexible material of tubular bodies 4 can be easily cut from the remainder thereof and periodically secured onto a small tree limb to mark a trail for rescuers, while the remainder of tubular bodies 4 can continue to be worn by the person to enhance his or her visibility and increase the likelihood of a prompt rescue. Although not shown, if present invention 2 is included as part of an emergency kit having a clothespin or clip, the clothespin or clip could be used to assist attachment of tubular body 4 to a tree limb; an abandoned vehicle, airplane, or boat; a belt; a belt loop; an article of clothing; or a sizeable enclosure or container for equipment or gear.

What is claimed is:

1. A high visibility device for attracting the attention of on-lookers and signaling the need for emergency assistance, and which can be worn on a human limb, said device comprising:

an elongated flexible tubular member that is substantially rectangular in appearance when not in use and laying flat in a fully extended position, said tubular member being fluorescent orange in color and having an open end, as well as an opposing end that is substantially closed except for a small starter hole adapted for insertion and withdrawal therethrough of human hands and feet, said starter hole being smaller than the smallest adult hand contemplated for use therewith, said tubular member also being made from lightweight plastic material with a wall thickness sufficient to resist longitudinal collapse as a result of the force of gravity when said tubular member is given a circular cross-sectional configuration and placed in a vertically extended orientation, said tubular member also having sufficient elasticity to stretch respectively around a hand or foot inserted into said starter hole and then contract sufficiently around the adjacent wrist or ankle during deployment of said tubular member over a human limb so that said starter hole is able to function as an anchoring point for said tubular member during said deployment.

2. The device of claim 1 wherein said tubular member is made from extruded plastic material.

3. The device of claim 1 further comprising markings on said tubular member.

4. The device of claim 3 wherein said markings are selected from a group consisting of informational markings, decorative markings, and instructional markings.

5. The device of claim 1 wherein said small starter hole is selected from a group consisting of cutouts with angular perimeter dimensions, notches with angular perimeter dimensions, cutouts with arcuate perimeter dimensions, notches with arcuate perimeter dimensions, cutouts with curvilinear perimeter dimensions, and notches with curvilinear perimeter dimensions.

6. The device of claim 1 further comprising at least one pocket attached to said tubular member.

7. The device of claim 1 wherein said tubular member has a plurality of small spaced-apart perforations therethrough adapted to enhance user comfort during warm weather and reduce limb dehydration.

8. The device of claim 1 wherein said tubular member has a wall-thickness allowing said tubular member to be folded into a volume of less than two cubic inches.

9. The device of claim 1 wherein said tubular member has a minimum thickness dimension of approximately one millimeter and said starter hole has minimum non-stretched length and height dimensions of approximately two inches and one-half inch, respectively.

10. A high visibility device for attracting the attention of on-lookers and signaling the need for emergency assistance, and which can be worn on a human limb, said device comprising:

an elongated flexible tubular member that is substantially rectangular in appearance when not in use and laying flat in a fully extended position, said tubular member being fluorescent orange in color and having an open end, as well as an opposing end that is substantially closed except for a small starter hole adapted for insertion and withdrawal therethrough of human hands and feet, said starter hole being smaller than the smallest adult hand contemplated for use therewith, said tubular member also being made from lightweight plastic material having a minimum wall thickness of approximately one millimeter and sufficient rigidity to resist longitudinal collapse due to the force of gravity when said tubular member is given a circular cross-sectional configuration and placed in a vertically extended orientation, said tubular member also having sufficient elasticity to stretch respectively around a hand or foot inserted into said starter hole and then contract sufficiently around the adjacent wrist or ankle during deployment of said tubular member over a human limb so that said starter hole is able to function as an anchoring point for said tubular member during said deployment.

11. The device of claim 10 further comprising markings on said tubular member, and wherein said markings are selected from a group consisting of informational markings, decorative markings, and instructional markings.

12. The device of claim 10 wherein said small starter hole is selected from a group consisting of cutouts with angular perimeter dimensions, notches with angular perimeter dimensions, cutouts with arcuate perimeter dimensions, notches with arcuate perimeter dimensions, cutouts with curvilinear perimeter dimensions, and notches with curvilinear perimeter dimensions.

13. The device of claim 10 further comprising at least one pocket attached to said tubular member.

14. The device of claim 10 wherein said tubular member has a plurality of small spaced-apart perforations therethrough adapted to enhance user comfort during warm weather and reduce limb dehydration.

15. The device of claim 10 wherein said tubular member has a wall-thickness allowing said tubular member to be folded into a volume of less than two cubic inches.

16. A method for manufacturing a device used for attracting the attention of on-lookers and signaling the need for emergency assistance, which can be worn on human limb, said method comprising the steps of:

providing a quantity of flexible orange plastic material that has sufficient elasticity to stretch and then contract substantially back to its original configuration, said material also having sufficient rigidity to resist collapse due to the force of gravity when given a circular cross-sectional configuration and placed into a vertically extended orientation;

forming at least a portion of said plastic material into an elongated tubular member which when flattened into a rectangular configuration has approximate minimum length and width dimensions of eighteen and nine inches, respectively, as well as one closed end; and forming a small starter hole in said closed end that is adapted for insertion and withdrawal therethrough of human hands and feet, said starter hole being smaller than the smallest adult hand contemplated for use therewith, said starter hole also adapted in configuration and size so as to function as an anchoring point respectively around a wrist or ankle during deployment of said elongated tubular member over a human limb.

17. The method of claim 16 further comprising a step of placing markings on said tubular member, and wherein said markings are selected from a group consisting of informational markings, decorative markings, and instructional markings.

18. The method of claim 16 wherein said step of making said starter hole in said closed end of said tubular member is selected from a group consisting of making a central cutout in said closed end with an angular perimeter dimension, making a central notch in said closed end with an angular perimeter dimension, making a central cutout in said closed end with an arcuate perimeter dimension, making a central notch in said closed end with an arcuate perimeter dimension, making a central cutout in said closed end with a curvilinear perimeter dimension, and making a central notch in said closed end with a curvilinear perimeter dimension.

19. The method of claim 16 further comprising the steps of providing at least one pocket and attaching each said pocket to said tubular member.

20. The method of claim 16 wherein said tubular member has a plurality of small spaced-apart perforations therethrough adapted to enhance user comfort during warm weather and reduce limb dehydration.

* * * * *